US011981496B2

(12) United States Patent
Burgess et al.

(10) Patent No.: US 11,981,496 B2
(45) Date of Patent: May 14, 2024

(54) FOOD-STORAGE CONTAINER

(71) Applicant: WHIRLPOOL CORPORATION, Benton Harbor, MI (US)

(72) Inventors: Brent Burgess, Edwardsburg, MI (US); Scott E Carpenter, Cassopolis, MI (US); Christopher Hartnett, St. Joseph, MI (US); Zachary Saylor, St. Joseph, MI (US); Joel M. Sells, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/889,934

(22) Filed: Aug. 17, 2022

(65) Prior Publication Data

US 2024/0059474 A1 Feb. 22, 2024

(51) Int. Cl.

| | |
|---|---|
| ***B65D 81/34*** | (2006.01) |
| ***B65D 43/02*** | (2006.01) |
| ***B65D 45/18*** | (2006.01) |
| ***B65D 45/20*** | (2006.01) |
| ***B65D 51/16*** | (2006.01) |

(52) U.S. Cl.

CPC ..... *B65D 81/34* (2013.01); *B65D 43/0254* (2013.01); *B65D 45/18* (2013.01); *B65D 45/20* (2013.01); *B65D 51/165* (2013.01); *B65D 51/1683* (2013.01); *B65D 2205/02* (2013.01); *B65D 2543/00101* (2013.01); *B65D 2581/34* (2013.01)

(58) Field of Classification Search

CPC .... B65D 81/34; B65D 43/0254; B65D 45/18; B65D 45/20; B65D 51/165; B65D 51/1683; B65D 2205/02; B65D 47/32

See application file for complete search history.

(56) References Cited

U.S. PATENT DOCUMENTS

| | | | |
|---|---|---|---|
| 5,641,065 | A | 6/1997 | Owens et al. |
| D427,769 | S | 7/2000 | Zimmerman |
| D483,622 | S | 12/2003 | Kim |
| D514,811 | S | 2/2006 | Koo |
| D617,150 | S | 6/2010 | Olivari |
| D651,479 | S | 1/2012 | Nie |
| D653,915 | S | 2/2012 | George |

(Continued)

FOREIGN PATENT DOCUMENTS

| | | | | |
|---|---|---|---|---|
| BR | 102019005478 B1 * | 6/2022 | ..... | A47J 27/002 |
| KR | 200392793 Y1 * | 2/2005 | | |

OTHER PUBLICATIONS

English translation of KR-200392793-Y1 (Year: 2023).*
English translation of BR-102019005478-B1 (Year: 2023).*

*Primary Examiner* — James N Smalley
(74) *Attorney, Agent, or Firm* — Brooks Kushman P.C.

(57) ABSTRACT

A food-storage container includes a container body defining a storage area and a rim. A removable lid is connectable to the rim to seal the storage area. The lid defines a vent hole. A latch assembly of the container has a latch and a vent flap. The latch is pivotally attached to the lid and is configured to engage with the container body to secure the lid to the rim when in a latched position. The vent flap is pivotal relative to the latch between an open position in which the flap is spaced from the vent hole and a sealing position in which the flap seals the vent hole.

20 Claims, 5 Drawing Sheets

(56) References Cited

U.S. PATENT DOCUMENTS

| | | | | |
|---|---|---|---|---|
| 8,662,334 | B2 | 3/2014 | Turvey et al. | |
| 8,998,014 | B2 * | 4/2015 | Iwasaki | A45C 11/20 220/254.1 |
| D738,623 | S | 9/2015 | Wood | |
| D758,805 | S | 6/2016 | Myoung | |
| D785,940 | S | 5/2017 | Reed | |
| D796,266 | S | 9/2017 | Croft et al. | |
| 9,801,488 | B2 | 10/2017 | Affatato et al. | |
| D803,631 | S | 11/2017 | Min et al. | |
| D808,228 | S | 6/2018 | Weernick | |
| D826,557 | S | 8/2018 | Han | |
| D830,765 | S | 10/2018 | Croft et al. | |
| 10,173,826 | B2 | 1/2019 | Sexton et al. | |
| 10,793,325 | B2 | 10/2020 | Cheng | |
| 10,889,414 | B2 | 1/2021 | Liu | |
| 2004/0232026 | A1 | 11/2004 | Goeking et al. | |
| 2018/0265267 | A1 * | 9/2018 | Arenas | B65D 45/00 |

* cited by examiner

FOOD-STORAGE CONTAINER

TECHNICAL FIELD

The present disclosure relates to food-storage containers having vents and latches.

BACKGROUND

A food-storage container may include a container body and a removable lid. Generally, the lid is configured to create an airtight seal between the lid and the container body. The container body may be formed of glass or plastic.

SUMMARY

According to one embodiment, a food-storage container includes a container defining a storage area and a rim. A removable lid is connectable to the rim to seal the storage area. The lid has a latch-connecting portion defining a vent hole. A latch assembly of the container has a latch and a vent flap. The latch is pivotally attached to the lid at the latch-connecting portion and is configured to engage with the container to secure the lid to the container when in a latched position. The vent flap is pivotal relative to the latch between an open position in which the flap is spaced from the vent hole and a sealing position in which the flap seals the vent hole.

According to another embodiment, a food-storage container includes a container defining a storage area and a rim and a removable lid connectable to the rim to seal the storage area and defining an opening. A valve assembly is disposed in the opening and has an inlet valve configured to allow air into the container and an outlet valve configured to allow air out of the container.

According to yet another embodiment, a food-storage container includes a container defining a storage area and a rim and a removable lid connectable to the rim to seal the storage area and defining an opening. A passive bi-directional valve is disposed in the opening and configured to allow ingress and egress of air into and out of the container. A latch is pivotally attached to the lid and configured to engage with the container to secure the lid to the container when in a latched position.

DETAILED DESCRIPTION

Figure 2:
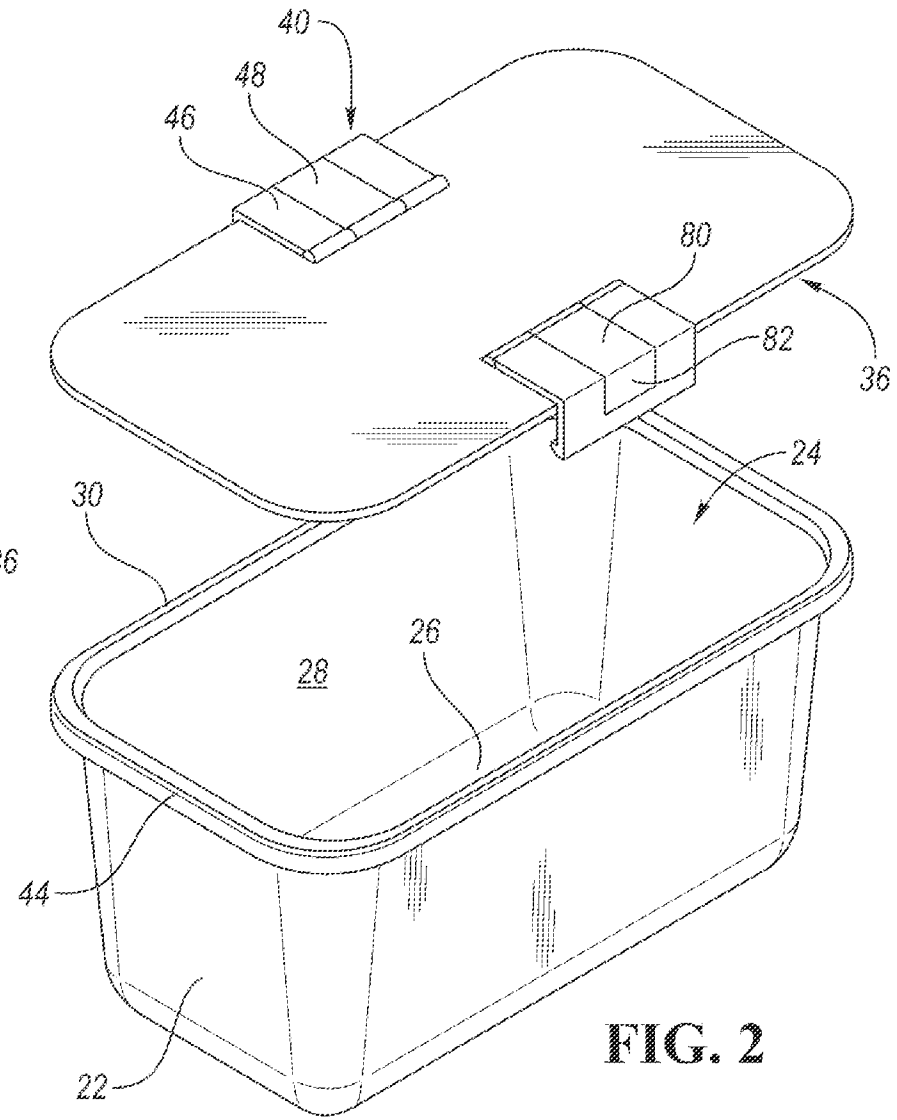
FIG. 2 is an exploded perspective view of the food-storage container of FIG. 1.
Figure 1:
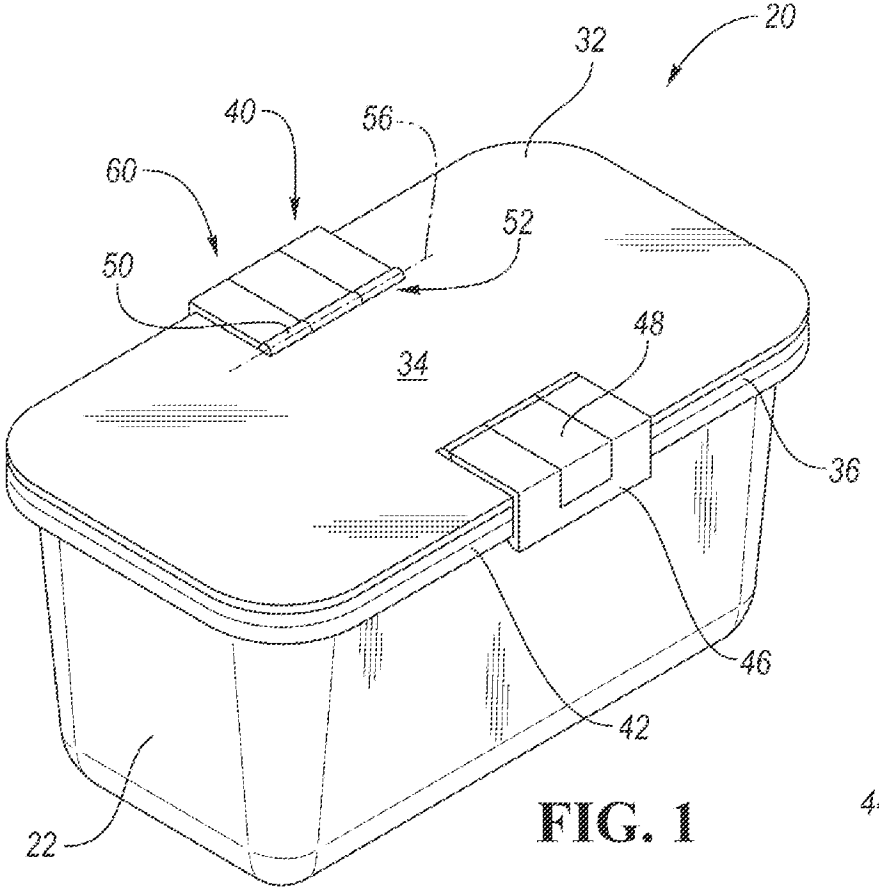
FIG. 1 is a perspective view of a food-storage container according to a first embodiment.
Figure 3:
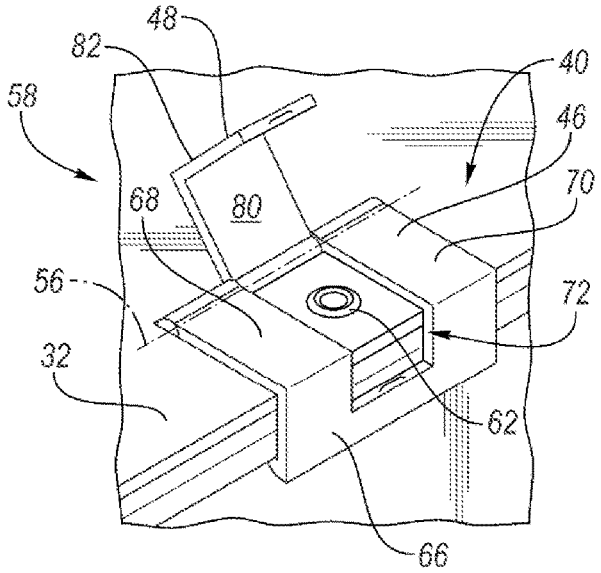
FIG. 3 is a detail view of a latch assembly of the food-storage container of FIG. 1 shown in a first position.
Figure 4:
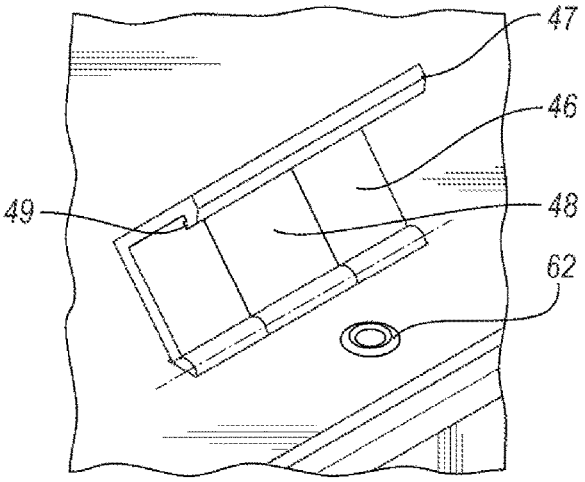
FIG. 4 is a detail view of the latch assembly of the food-storage container of FIG. 1 shown in a second position.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Referring to FIGS. 1 through 4, a food-storage container 20 includes a container body 22 defining a food-storage area 24. The container body 22 includes a floor (bottom wall) 26 and sidewalls 28 extending upwardly from the floor 26 and terminating at a rim 30. The rim 30 my form the uppermost surface of the container 22. The floor 26 and the sidewalls 28 cooperate to form the boundary of the food-storage area 24, e.g., a cavity. When viewed from above, the container body 22 may resemble a rectangle, square, circle, or any other suitable shape.

A removable lid 32 is connectable to the rim 30 to seal the storage area 24. The lid 32 is sized and dimensioned to cover over the open top of the container body 22. The lid 32 may include an upper cover portion 34 and a sealing portion 36 that extend may downwardly from the cover portion 34. The sealing portion 36 his generally located around the perimeter of the lid 32. In some embodiments, the sealing portion 36 may be slightly inboard of the outer periphery of the lid 32. The size and location of the sealing portion 36 is designed to match the rim 30 of the container body 22 so that the sealing portion 36 is received on or over the rim 30 when the lid 32 is connected to the container body 22. The cover portion 34 may be formed of a more rigid material than the sealing portion 36, which may be a flexible material. For example, the cover portion 34 may be formed of plastic such as polypropylene, and the sealing portion 36 may be made of rubber such as a thermoplastic elastomer. This, of course, is just two example materials, and the food-storage container 20 of this application is not limited to any particular material.

The sealing portion 36 may be a sealing lip that includes a wiper seal that sealingly engages the rim 30 and an upper inner surface of the sidewalls 28. Alternatively, the sealing portion 36 may include a gasket that seats on top of the rim 30.

The removable lid 32 may be secured to the container body 22 by one or more latch assemblies 40. In the illustrated embodiment, the lid 32 includes a pair of latch assemblies 40 that are located on opposing sides of the lid 32. For example, the latch assemblies 40 are disposed on the longer sides 42 of the lid 32. In other embodiments, the latch assemblies 40 may be disposed on the shorter sides 44 of the lid 32, or the lid 32 may include four latch assemblies 40 on all sides of the lid 32.

The latch assemblies 40 include multiple moving components and are configured to both secure the lid 32 to the container body 22 and also to provide venting of the storage container 20. The venting features of the latch assemblies 40 are independently movable relative to the latching features so that the storage container 20 may be vented while the lid 32 is still secured to the container body 22.

In the illustrated embodiment, the latch assembly 40 includes a latch (main latch) 46 and a vent flap (secondary latch) 48 that may be movable independently of each other. The latch 46 may include a rear portion 50 that is pivotally attached to a latch-connecting portion 52 of the lid 32 at a pivot axis 56. The latch-connecting portion 52 may be at least partially recessed from a top surface 54 of the cover portion 34. When recessed, this allows the latch assembly 40 to be more flush with the lid 32. The latch 46 may include a pair of projections (not shown) that are received in recesses (not shown) defined in the lid 32 to form a hinge at the pivot axis 56. Alternatively, the cover portion 34 may define projections that are received within recesses of the latch 46. In yet another alternative embodiment, a pin may be used to pivotally attach the latch 46 to the lid 32, e.g., a piano hinge.

The latch 46 is movable between an unlatched position 58 in which the latch 46 is pivoted upwardly and out of contact with the container body 22 and a latched position 60 in which the latch 46 is pivoted downwardly to connect with the container body 22 and secure the lid 32 to the container 22. The latch 46 includes a gripping portion 47 configured to engage with the container body 22 when in the latched position 60. The gripping portion 47 may grab the rim 30 of the container body 22. For example, the gripping portion 47 may include a tab 49 that hooks onto a bottom wall of the rim 30 to form a click fit. Of course, other types of connection may be used, and the latch 46 is not limited to any particular design.

The lid 32 may include one or more vents 62, such as a hole, near the one or more latch-connecting portions 52 so that the vents are disposed under the latch assemblies 40. The number of vents 62 may match the number of latch assemblies 40. In the illustrated embodiment, the storage container 20 includes two vents 62 corresponding to the two latch assemblies 40. The vent hole may be circular, ovular, an elongated slot, rectangular, or any other suitable shape. In some embodiments, the vent 62 may include a plurality of openings, holes, or slots grouped together to form the vent 62. The vent 62 may extend from the top surface of the lid 32 to the bottom surface of the lid 32 so that the food-storage area 24 can be in fluid communication with the outside air even when the lid 32 is attached to the container body 22. The vent 62 allows the storage container 20 to be heated, e.g., microwaved, with the lid 32 still attached since steam can escape through the vent 62. The vent 62 also allows for the ingress of air while the food within the food-storage container 20 cools to prevent a vacuum from forming.

The vent flap(s) (secondary latch) 48 are configured to seal the one or more vents 62. The vent flap 48 is pivotally attached to either the latch 46 or the lid 32 and is pivotal between an open position in which the vent 62 is exposed and a sealing position (closed position) in which the vent 62 is sealed closed. When the vent flap 48 is in the open position, the food-storage area 24 is in fluid communication with the outside air to allow steam release during cooking. When the vent flap 48 is in the sealing position, the food-storage area 24 is not in fluid communication with the outside air to maintain freshness during storage of the food.

In the illustrated embodiment, the vent flap 48 is configured to nest within the latch 46. For example, the latch 46 may include a front portion 66 and side portions 68, 70 that cooperate to define a cutout 72. The cutout 72 is sized to receive the vent flap 48 therein. This allows for a compact and flush design of the latch assembly 40. The vent flap 48 may be pivotally attached to the latch 46 at the pivot axis 56. That is, the vent flap 48 and the latch 46 may share a common pivot axis. The vent flap 48 may include projections that are received within recesses formed in the sides 68, 70 (or vice versa) to form a pivotal connection between the vent flap 48 and the latch 46. Alternatively, a pin may extend through the lid 32, the latch 46, and the flap 48 to create the common pivot axis, e.g., axis 56. In other embodiments, the vent flap 48 may pivot about a different axis than the axis 56. For example, the pivot axis of the vent flap 48 may be substantially parallel to the pivot axis 56 but located outboard of the pivot axis 56. In other designs, the pivot axis of the vent flap 48 may be angled relative to the pivot axis 56. (See description of FIG. 5 below.)

The vent flap 48 may be pivotal relative to the latch 46 but also move in unison with the latch 46. For example, the vent flap 48 may be pivoted between the open and sealing positions while the latch 46 remains in the latched position, but is moved from the seal position to the open position when the latch 46 is opened. This gives the vent flap both independent and concerted movement with the latch 46.

The vent flap 48 may include a sealing portion 80 and a connecting portion 82. The sealing portion 80 is configured to seal the vent 62 when in the sealing position and the connecting portion is configured to secure the flap 48 in the sealing position. The connecting portion 82 may include features configured to engage with features of either the lid 32 or the latch 46. For example, the connecting portion 82 may click-fit to the latch 46 or the lid 32. In the illustrated embodiment, the that flap 48 is L-shaped so that the sealing portion 80 is angled relative to the connecting portion 82 at a substantially perpendicular angle. This matches the L-shaped latch 46 of the illustrated embodiment. Of course, the vent flap 48 may be a substantially planar component in other embodiments.

Figure 5:
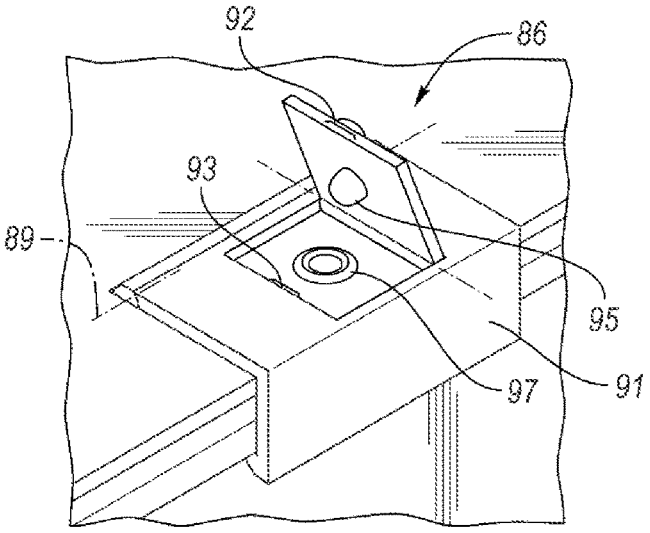
FIG. 5 is a latch assembly of the food-storage container according to an alternative embodiment.

Referring to FIG. 5, an alternative latch assembly 86 has a main latch 88 and a vent flap 90. The main latch 88 is pivotally attached to the lid 32 about a pivot axis 89. The vent flap 90 is pivotally attached to the main latch 88 about a pivot axis 91 that is substantially orthogonal to the pivot axis 89. The main latch 88 and the vent flap 90 may include cooperating features 92 and 93 for securing the vent flap 90 closed. In some embodiments, the vent flap 90 may be pivotally attached to the main latch 88 by a living hinge. An optional projection 95 may be provided on an underside of the vent flap 90. The projection 95 is sized to be received in the vent hole 97. While not shown above, a similar projection may be provided on the embodiment of FIGS. 1 through 4.

Figure 6:
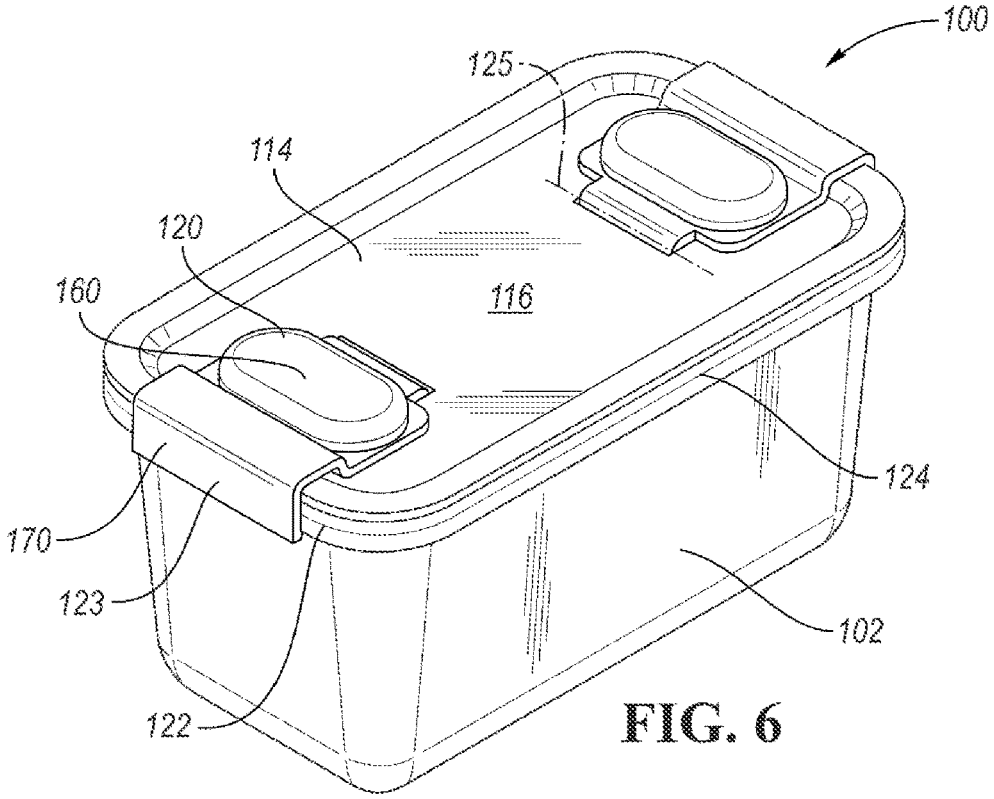
FIG. 6 is a perspective view of a food-storage container according to a second embodiment.
Figure 8:
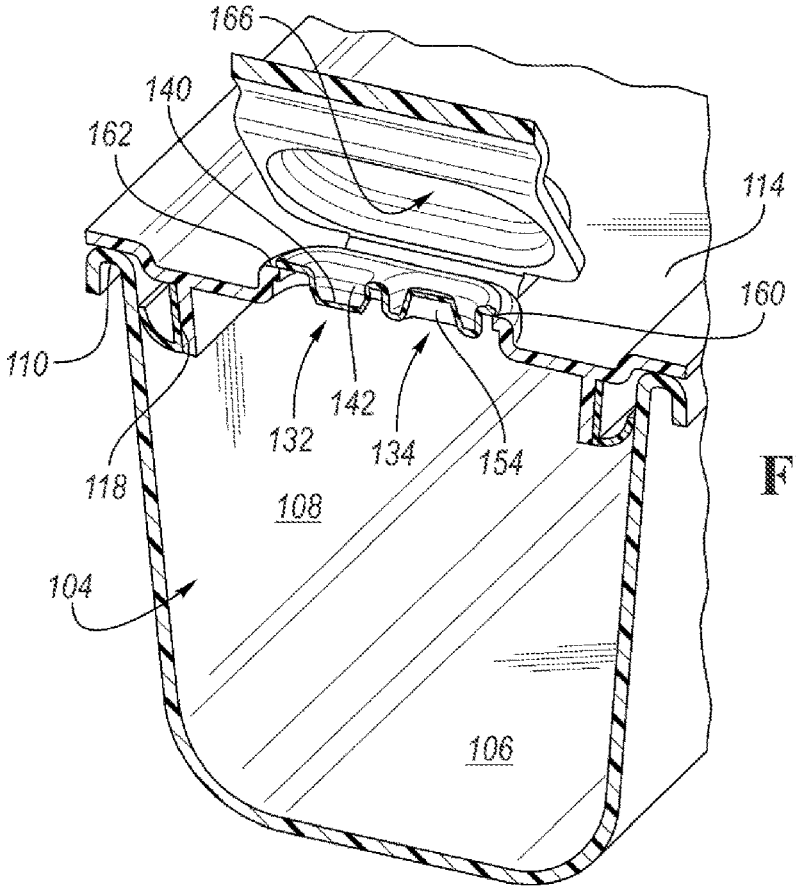
FIG. 8 is a cross-sectional perspective view of the latch and valve arrangement of FIG. 7.
Figure 7:
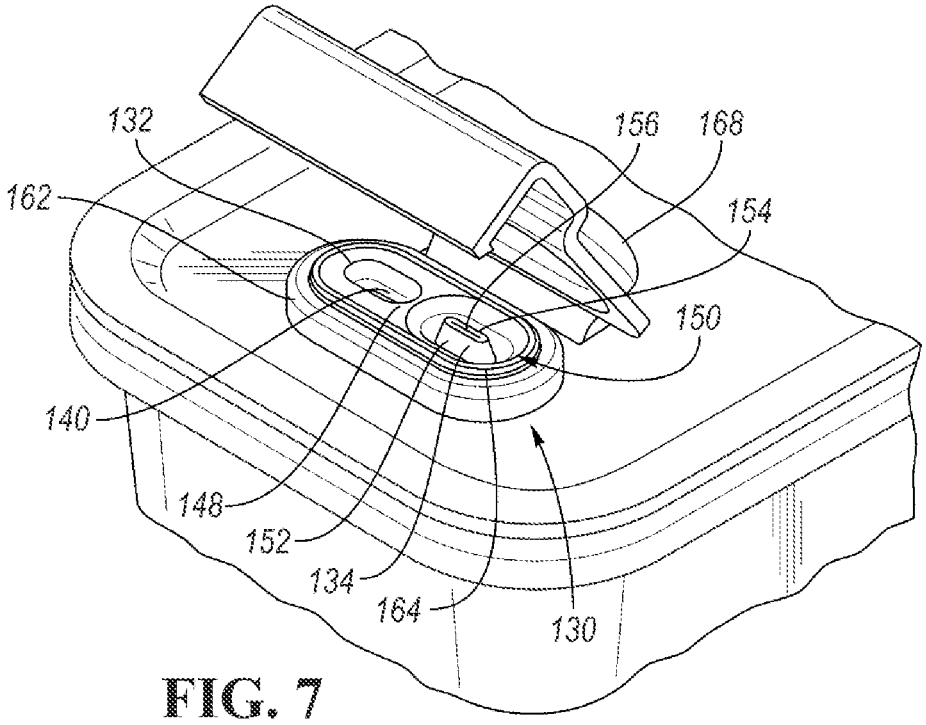
FIG. 7 is a perspective view of a latch and valve arrangement of the food-storage container of FIG. 6.

Referring to FIGS. 6 through 8, a food-storage container 100 includes a container body 102 defining a food-storage area 104. The container 100 includes a floor (bottom wall) 106 and sidewalls 108 extending upwardly from the floor 106 and terminating at a rim 110. The rim 110 may form the uppermost surface of the container 100. The floor 106 and the sidewalls 108 cooperate to form the boundary of the food-storage area 104, e.g., a cavity. When viewed from above, the container 100 may resemble a rectangle, square, circle, or any other suitable shape.

A removable lid 114 is connectable to the rim 110 to seal the storage area 104. The lid 114 is sized and dimensioned to cover over the open top of the container 100. The lid 114 may include an upper cover portion 116 and a sealing portion 118. The sealing portion 118 may be generally located around the perimeter of the lid 114. In some embodiments, the sealing portion 118 may be inboard of the outer periphery of the lid 114. The size and location of the sealing portion 118 is designed to match the rim 110 of the container body 102 so that the sealing portion 118 is received on or over the rim 30 when the lid 114 is connected to the container body 102. The lid 114 may seal to the container body 102 as described above with regards to the embodiment of FIGS. 1-4.

The removable lid 114 may be secured to the container body 102 by one or more latches 120. In the illustrated embodiment, the lid 114 includes a pair of latches 120 that are located on opposing sides of the lid 114. For example, the latches 120 are placed to latch with the shorter sides 122 of the lid 114. In other embodiments, the latches 120 may be placed to latch with the longer sides 124 of the lid 114, or the lid 114 may include four latches 120 on all sides of the lid 114. Each latch 120 is pivotally attached to the removable lid 114 and includes one or more features 123 configured to grip the container body 102, such as at the rim 110, to retain the removable lid 114 to the container body 102. The pivot axes 125 of the latches 120 may be located inboard from the periphery of the lid 114 and located in a more central position. When the latches 120 are in the unlatched position, the removable lid 14 can be removed from the container body 102, and when the latches 120 are in the latched position, the removable lid 114 is inhibited from being removed from the container body 102.

The lid 114 includes one or more valves. In the illustrated embodiment, the lid 114 includes one or more two-way valve assemblies 130. The valve assembly 130 may be a passive valve assembly that opens and closes based on pressure differential. The valve assembly 130 is configured to maintain the food-storage area 112 at or near atmospheric pressure during both heating of the food and subsequent cooling of the food. Each two-way valve assembly 130 includes an inlet valve 132 and an outlet valve 134. The inlet valve 132 is arranged to allow air to enter into the food-storage area 112, and the outlet valve is arranged to allow air to exit the food-storage area 112. For example, the outlet valve 134 allows hot air to escape during heating of the food so that pressure does not build within the food-storage area 112, and the inlet valve 132 allows outside air to flow into the food-storage area 112 during cooling of the food to prevent deformation of the container body 102 due to vacuum. The valve assembly 130 allows for venting to occur while the lid 114 is still attached to the container body 102.

The inlet valve 132 may be a duckbill valve. For example, the inlet valve 132 includes a flap arrangement 140 extending inwardly towards the container body 102. The flap arrangement 140 may include a pair of opposing flaps 142 that cooperate to define a slit (not visible). The flaps 142, 144 are biased to seal (close) the slit 146 thus placing the inlet valve 132 in a closed position. The flaps 142 project downwardly from a body 148 of the valve assembly 130 into the food-storage area 112. When the air pressure inside the container body 102 drops below atmospheric pressure (or some other threshold), the higher outside air pressure urges the opposing flaps 142 apart to open the slit 146 (moves the inlet valve to the open position) allowing air to enter into the food-storage area 112.

The outlet valve 134 may also be a duckbill valve. For example, the outlet valve 134 includes a flap arrangement 150 extending inwardly towards the container body 102. The flap arrangement 150 may include a pair of opposing flaps 152, 154 that cooperate to define a slit 156. The flaps 152, 154 are bias to seal (close) the slit 156 thus placing the outlet valve 134 in a closed position. The flaps 152 and 154 project upwardly from the body 158 of the valve assembly 130 into the food-storage area 112. When the air pressure inside the container body 102 exceeds atmospheric pressure (or some other threshold), the higher inside air pressure urges the opposing flaps 152 and 154 apart to open the slit 156 (moves the outlet valve to the open position) allowing air to exit into the food-storage area 112.

Thickness and durometer of the valve material affects pressure release-ranges of valves. Thus, the valves can be tuned by adjusting these variables to provide desired pressure release-ranges. This control may allow us to design for specific storage solutions based on what will be stored inside the containers 100 and the conditions they operate in (e.g., high altitude environments).

The inlet valve 132 and the outlet valve 134 may be integrally formed with the body 148 to form a single piece assembly. The body 148 may be receivable within an opening 160 defined by the lid 114. The opening 160 may be defined by a boss 162 that is raised from the upper cover portion 116. The body 148 may define a flange 164 that sealingly engages with the boss 162 to both support the valve assembly 130 and to provide a seal.

The one or more valve assemblies 130 may be placed in close proximity with the one or more latches 120. Alternatively, the two-way valve may be placed remote from the latches 120. In the illustrated embodiment, the openings 160 of the lid 114 are disposed near the pivot axes of the latches 120. This way, the valve assembly 130 is covered by its respective latch 120 when the latch 120 is in the closed position and is exposed when the latch 120 is in the open position.

The latch 120 may define a pocket 166 that is configured to receive the boss 162 and the valve assembly 130 therein when the latch 120 is in the closed position. The pocket 166 may be formed by raising or doming a portion 168 of the latch 120. The portion 168 may be a substantially straight and extend from the pivot axis to the connector portion 170, which is configured to snap fit to the container body 102, for example. The size and shape of the pocket 166 may be substantially the same as the size and shape of the boss 162 albeit slightly larger to accommodate the boss therein. The pocket 166 may be sized to seal with the boss 162 so that the valve assembly 130 is sealed when the latch 120 is in the closed position. In the illustrated embodiment, the pocket 166 is ovular to match the ovular shape of the boss 162 and the valve assembly 130. This, of course, is just an example, and the shapes of the pocket 166, boss 162, and valve assembly 130 may be different in other embodiments.

Figure 9:
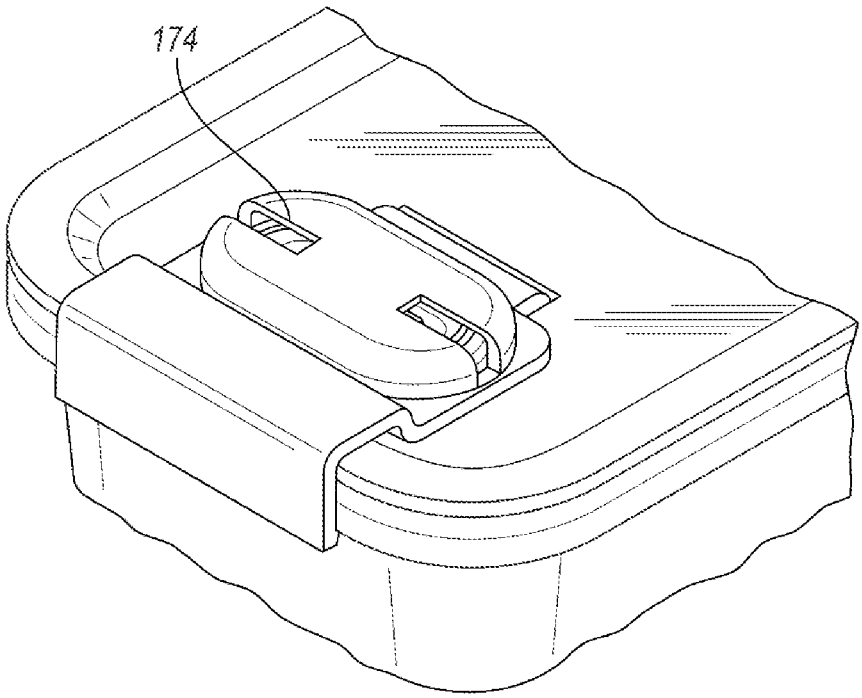
FIG. 9 is a perspective view of a food-storage container of FIG. 6 with an alternative latch having vents.

FIG. 9 illustrates an alternative embodiment in which one or more latches 120 are vented allowing for venting even when the latch is in the closed position. For example, one or more slots 174 may be provided at the pocket 166. In the illustrated embodiment, a pair of slots 174 are provided with each slot being disposed above either the inlet valve or the outlet valve. The slots 174 extend completely through a thickness of the latch so that the pocket is always in fluid communication with the atmosphere. While FIG. 9 illustrates slots, the vents may be any shape such as holes, slits, or any other opening.

Figure 10:
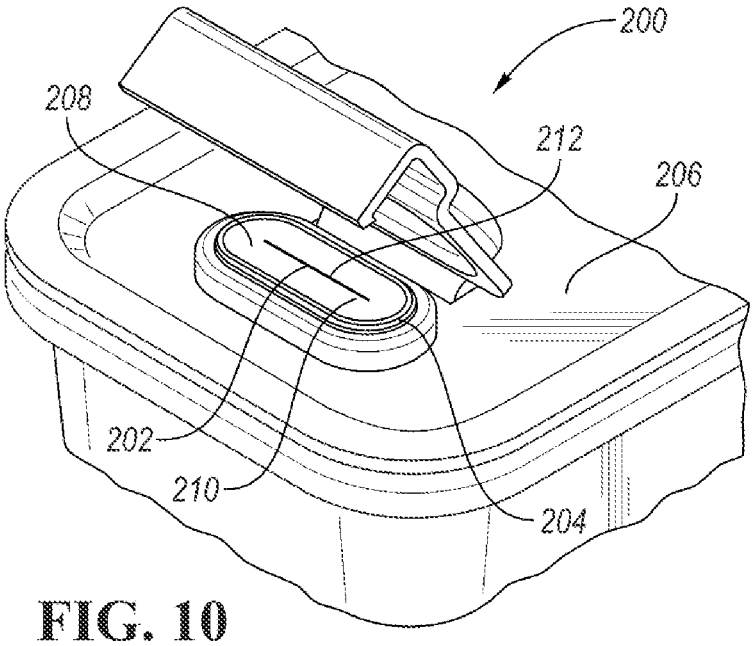
FIG. 10 is a perspective view of a food-storage container according to a third embodiment.
Figure 11:
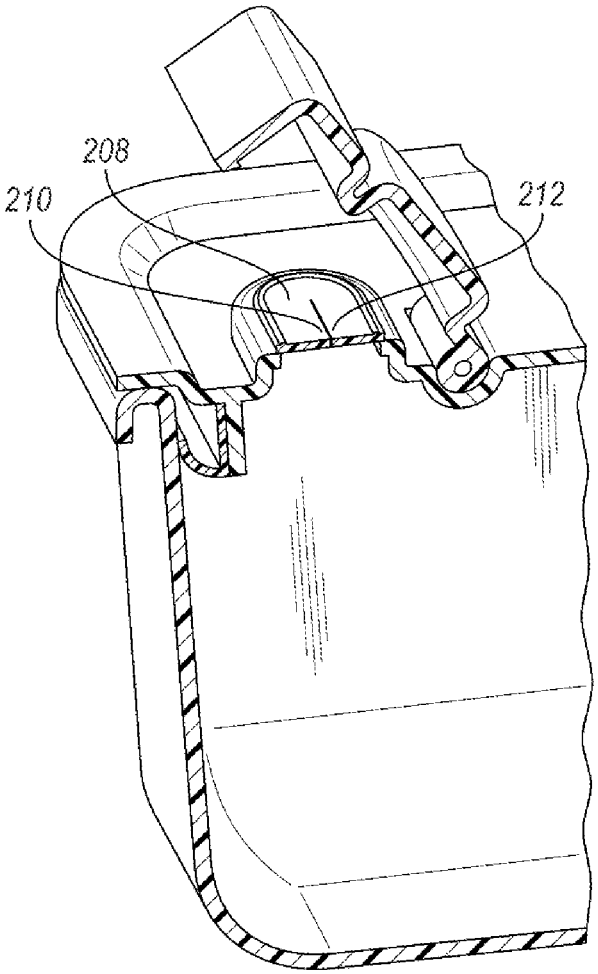
FIG. 11 is a cross-sectional perspective view of the food-storage container of FIG. 10.

FIGS. 10 and 11 illustrate an alternative design for the valve assembly. A valve assembly 200 is a passive two-way (or bi-directional) valve that is configured to act as both an inlet valve and an outlet valve in order to maintain the food-storage area at substantially atmospheric pressure. The valve assembly 200 is configured to act as an outlet valve during heating of the food to allow the escape of hot gases, and to act as an inlet valve during cooling of the food to inhibit the formation of a vacuum within the food-storage area. Rather than employing a pair of valves, the valve assembly 200 includes a single slit 202 that forms both an inlet valve and an outlet valve depending upon present conditions.

The bidirectional valve 200 may include an outer border 204 that is attached to the lid 206. A membrane 208 is supported by the border 204. The membrane 208 defines the slit 202. The membrane 208 is flexible and is design to seal the slit 202 by having opposing sides 210, 212 in contact with each other under normal conditions, i.e., the pressure differential between the food-storage area and the atmosphere is less than a threshold. That is, the resting state of the membrane 208 biases the opposing sides 210 and 212 into contact with each other. When a pressure differential across the valve exceeds a threshold, the membrane 208 flexes causing the opposing sides 210 and 212 to spread apart and open the slit 202, thus opening the valve. For example, the bi-directional valve 200 acts as an outlet valve during heating by allowing hot gases to escape through the slit 202 and acts as an inlet valve during cooling by allowing atmospheric air to be drawn into the food-storage area through the slit 202.

The above-described valves may be integrated with the lid or may be separate component that are attached to the lid. For example, when integrated, the valves may be overmolded with the lid, and when separate, the valve may be threadably attached to the lid. Of course, these are just two example attachments of the valves and this disclosure is not limited to any particular way of securing the valves to the lid.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A food-storage container comprising:

a container body defining a storage area and a rim;

a removable lid connectable to the rim to seal the storage area and defining a vent hole; and a latch assembly including a latch and a vent flap, wherein the latch is pivotally attached to the lid and is configured to engage with the container body to secure the lid to the rim when in a latched position, and wherein the vent flap is pivotally connected to the latch to be pivotal between an open position in which the flap is spaced from the vent hole and a sealing position in which the flap seals the vent hole.

2. A food-storage container comprising:

a container body defining a storage area and a rim;

a removable lid connectable to the rim to seal the storage area and defining a vent hole; and a latch assembly including a latch and a vent flap, wherein the latch is pivotally attached to the lid and is configured to engage with the container body to secure the lid to the rim when in a latched position, and wherein the vent flap is pivotal relative to the latch between an open position in which the flap is spaced from the vent hole and a sealing position in which the flap seals the vent hole, wherein the vent flap is nested within the latch.

3. The food-storage container of claim 2, wherein the latch includes a central cutout and the vent flap is receivable within the cutout.

4. The food-storage container of claim 1, wherein the vent flap is independently pivotal relative to the latch such that the vent flap is movable from the closed position to the open position while the latch is in the latched position.

5. The food-storage container of claim 1, wherein the vent flap includes a sealing portion configured to seal the vent hole and a connecting portion configured to secure the vent flap in the sealing position.

6. The food-storage container of claim 5, wherein the sealing portion and the connecting portion are angled relative to each other.

7. A food-storage container comprising:

a container body defining a storage area and a rim;

a removable lid connectable to the rim to seal the storage area and defining a vent hole; and a latch assembly including a latch and a vent flap, wherein the latch is pivotally attached to the lid and is configured to engage with the container body to secure the lid to the rim when in a latched position, and wherein the vent flap is pivotal relative to the latch between an open position in which the flap is spaced from the vent hole and a sealing position in which the flap seals the vent hole, wherein the latch and the vent flap have a common pivot axis.

8. The food-storage container of claim 1, wherein the latch is pivotally attached to the lid at a first pivot axis, and the vent flap is pivotally attached to the latch at a second pivot axis.

9. The food-storage container of claim 8, wherein the first and second pivot axes are angled relative to each other.

10. The food-storage container of claim 1, wherein the vent flap includes a projection receivable within the vent hole when the vent flap is in the sealing position.

11. The food-storage container of claim 1, wherein the vent flap is pivotally connected to the latch such that the vent flap moves in unison with the latch when the vent flap is in the sealing position.

12. The food-storage container of claim 2, wherein the vent flap is independently pivotal relative to the latch such that the vent flap is movable from the closed position to the open position while the latch is in the latched position.

13. The food-storage container of claim 2, wherein the vent flap includes a sealing portion configured to seal the vent hole and a connecting portion configured to secure the vent flap in the sealing position.

14. The food-storage container of claim 13, wherein the sealing portion and the connecting portion are angled relative to each other.

15. The food-storage container of claim 2, wherein the latch is pivotally attached to the lid at a first pivot axis, and the vent flap is pivotally attached to the latch at a second pivot axis.

16. The food-storage container of claim 15, wherein the first and second pivot axes are angled relative to each other.

17. The food-storage container of claim 7, wherein the latch includes a central cutout and the vent flap is receivable within the cutout.

18. The food-storage container of claim 7, wherein the vent flap is independently pivotal relative to the latch such that the vent flap is movable from the closed position to the open position while the latch is in the latched position.

19. The food-storage container of claim 7, wherein the vent flap includes a sealing portion configured to seal the vent hole and a connecting portion configured to secure the vent flap in the sealing position.

20. The food-storage container of claim 7, wherein the vent flap includes a projection receivable within the vent hole when the vent flap is in the sealing position.

* * * * *